US008267713B2

(12) United States Patent
Wu

(10) Patent No.: US 8,267,713 B2
(45) Date of Patent: Sep. 18, 2012

(54) CABLE CONNECTOR ASSEMBLY WITH LATCH MECHANISM HAVING A LATCH MEMBER WITH PINS AND A PULLING MEMBER WITH HOLES CORRESPONDING TO THE PINS

(75) Inventor: Jerry Wu, Irvine, CA (US)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 13/118,598

(22) Filed: May 31, 2011

(65) Prior Publication Data

US 2011/0294333 A1 Dec. 1, 2011

(30) Foreign Application Priority Data

May 31, 2010 (CN) ..... 2010 2 0209263

(51) Int. Cl.
*H01R 13/62* (2006.01)

(52) U.S. Cl. ..... 439/352

(58) Field of Classification Search ..... 439/345, 439/352–358
See application file for complete search history.

(56) References Cited

U.S. PATENT DOCUMENTS

| | | | | |
|---|---|---|---|---|
| 7,238,040 | B1 | 7/2007 | Wu | |
| 7,281,937 | B2 * | 10/2007 | Reed et al. | 439/352 |
| 7,581,978 | B1 * | 9/2009 | Briant | 439/358 |
| 7,651,341 | B2 | 1/2010 | Wu | |
| 7,938,669 | B2 * | 5/2011 | Li et al. | 439/352 |
| 2007/0243749 | A1 * | 10/2007 | Wu | 439/352 |
| 2011/0195586 | A1 * | 8/2011 | Wu | 439/152 |
| 2011/0195590 | A1 * | 8/2011 | Wu | 439/345 |
| 2011/0195614 | A1 * | 8/2011 | Wu | 439/676 |

* cited by examiner

*Primary Examiner* — Chandrika Prasad
(74) *Attorney, Agent, or Firm* — Wei Te Chung; Andrew C. Cheng; Ming Chieh Chang

(57) ABSTRACT

A cable connector assembly includes a housing and a plurality of conductive contacts located in the housing. The housing defines a receiving room therein and a mating port through which a complementary connector is inserted into the receiving room. A plurality of cables electrically connects with the conductive contacts. A latch mechanism is assembled to an outside face of the housing and includes a latch member and a pulling member connecting with the latch member. The latch member defines a pair of hook portions inserted into the receiving room from the outside face and latching with the complementary connector. The latch member further defines a pair of shaft pins and the pulling member defines a pair of shaft holes. The shaft pins are pivotedly received in the shaft holes.

12 Claims, 9 Drawing Sheets

CABLE CONNECTOR ASSEMBLY WITH LATCH MECHANISM HAVING A LATCH MEMBER WITH PINS AND A PULLING MEMBER WITH HOLES CORRESPONDING TO THE PINS

BACKGROUND OF THE INVENTION

1. Field of the Invention

The present invention relates to a cable connector assembly, and more particularly to a cable connector assembly with a latch mechanism used for high-speed signal transmission.

2. Description of the Related Art

U.S. Pat. No. 7,238,040 issued on Jul. 3, 2007 discloses a cable connector assembly includes a housing, a circuit board received in the housing, a cable electrically connecting with the circuit board and a metal shell covering on the housing. The housing includes a lower shielding part, an upper shielding part assembled to the lower shielding part and a receiving room defined between the lower shielding part and the upper shielding part. The cable connector assembly further includes a latch mechanism assembled to the housing and the mating shell partially shields on the latch mechanism. The latch mechanism includes a latch member latching with a complementary connector and a pulling member cooperating with the latch member to actuate the latch member to unlatch from the complementary connector. So the assembled method of the pulling member to the latch member must be flexible and stable.

In view of the above, a new cable connector assembly is desired.

SUMMARY OF THE INVENTION

Accordingly, an object of the present invention is to provide a cable connector assembly with a latch mechanism to make a complementary connector easy to insert into and separate from the cable connector assembly.

To fulfill the above-mentioned object, a cable connector assembly comprises a housing and a plurality of conductive contacts located in the housing. The housing defines a receiving room therein and a mating port through which a complementary connector is inserted into the receiving room. A plurality of cables electrically connects with the conductive contacts. A latch mechanism is assembled to an outside face of the housing and comprises a latch member and a pulling member connecting with the latch member. The latch member defines a pair of hook portions inserted into the receiving room from the outside face and latching with the complementary connector. The latch member further defines a pair of shaft pins and the pulling member defines a pair of shaft holes. The shaft pins are pivotedly received in the shaft holes.

Other objects, advantages and novel features of the invention will become more apparent from the following detailed description when taken in conjunction with the accompanying drawings.

DETAILED DESCRIPTION OF THE PREFERRED EMBODIMENT OF THE INVENTION

Figure 1:
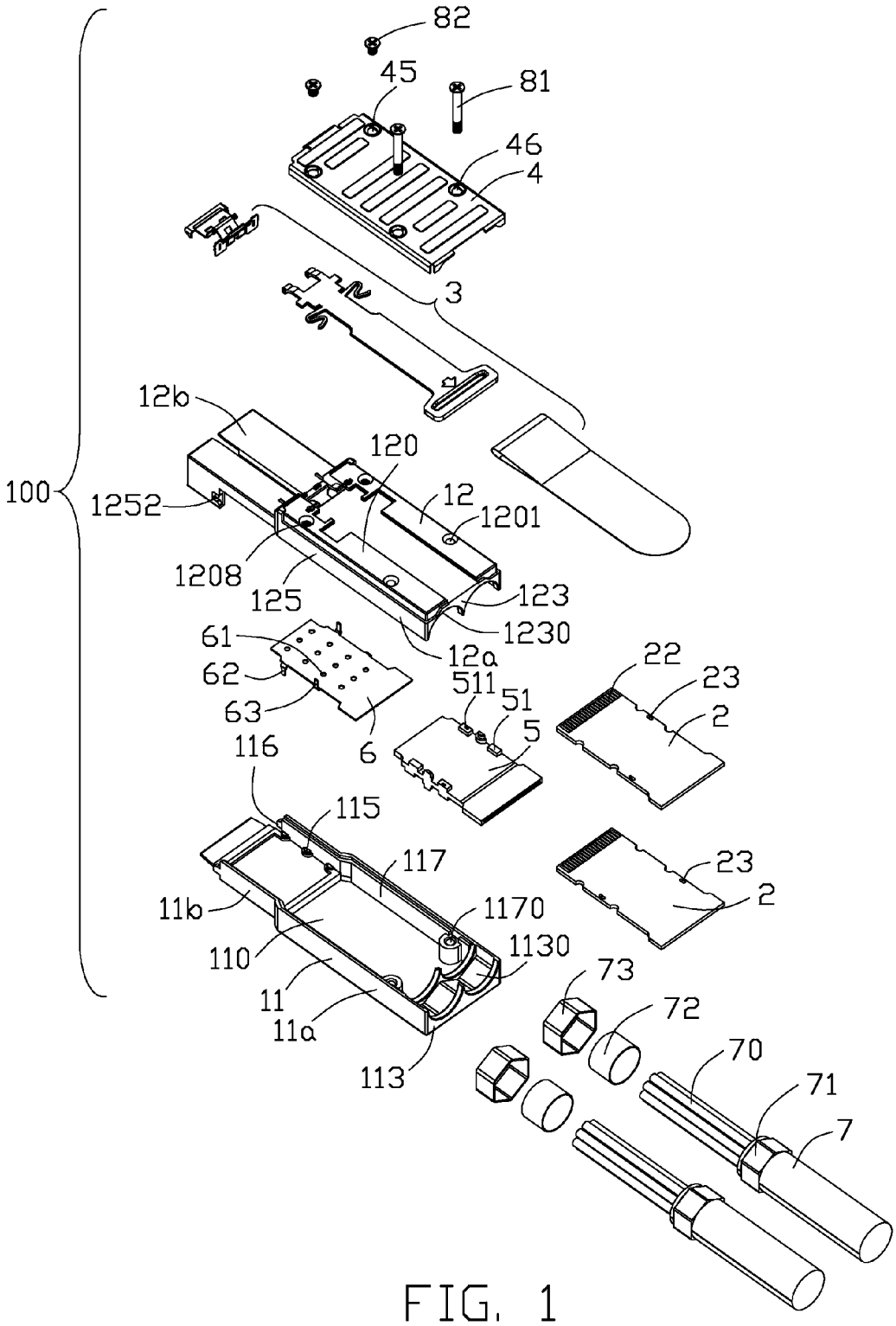
FIG. 1 is a top exploded view of a cable connector assembly of the present invention.

Reference will now be made to the drawings to describe the present invention in detail.

Referring to FIGS. 1-7, a cable connector assembly 100 includes a metal housing 1, a pair of circuit boards 2 received in the metal housing 1, a pair of cables 7 electrically connecting with the circuit boards 2, a latch mechanism 3 assembled to the metal housing 1 and a metal shell 4 partially shielding the latch mechanism 3.

Figure 3:
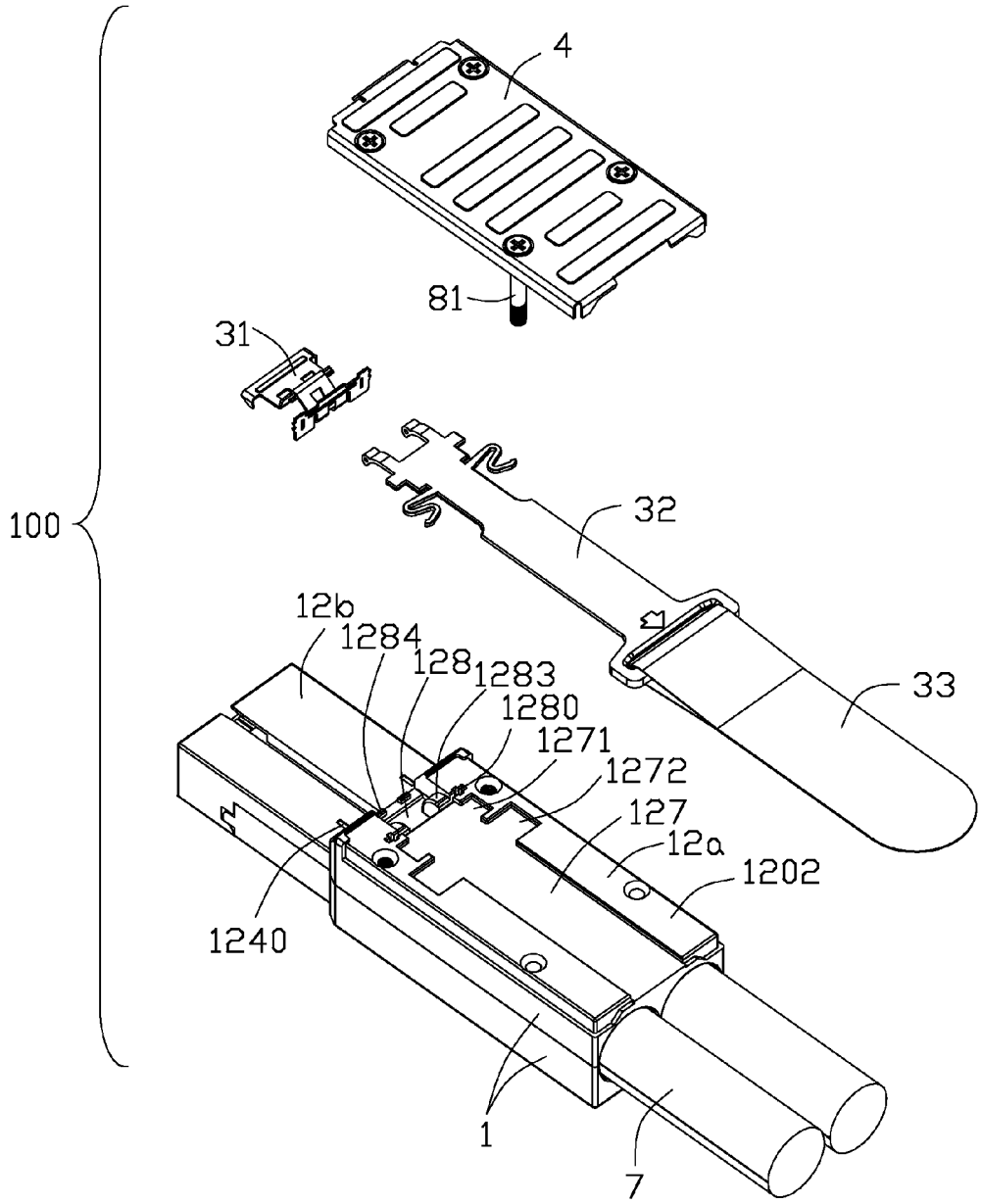
FIG. 3 is a top part exploded perspective view of the cable connector assembly of FIG. 1 wherein a latch mechanism and a metal shell are not assembled to the cable connector assembly.
Figure 4:
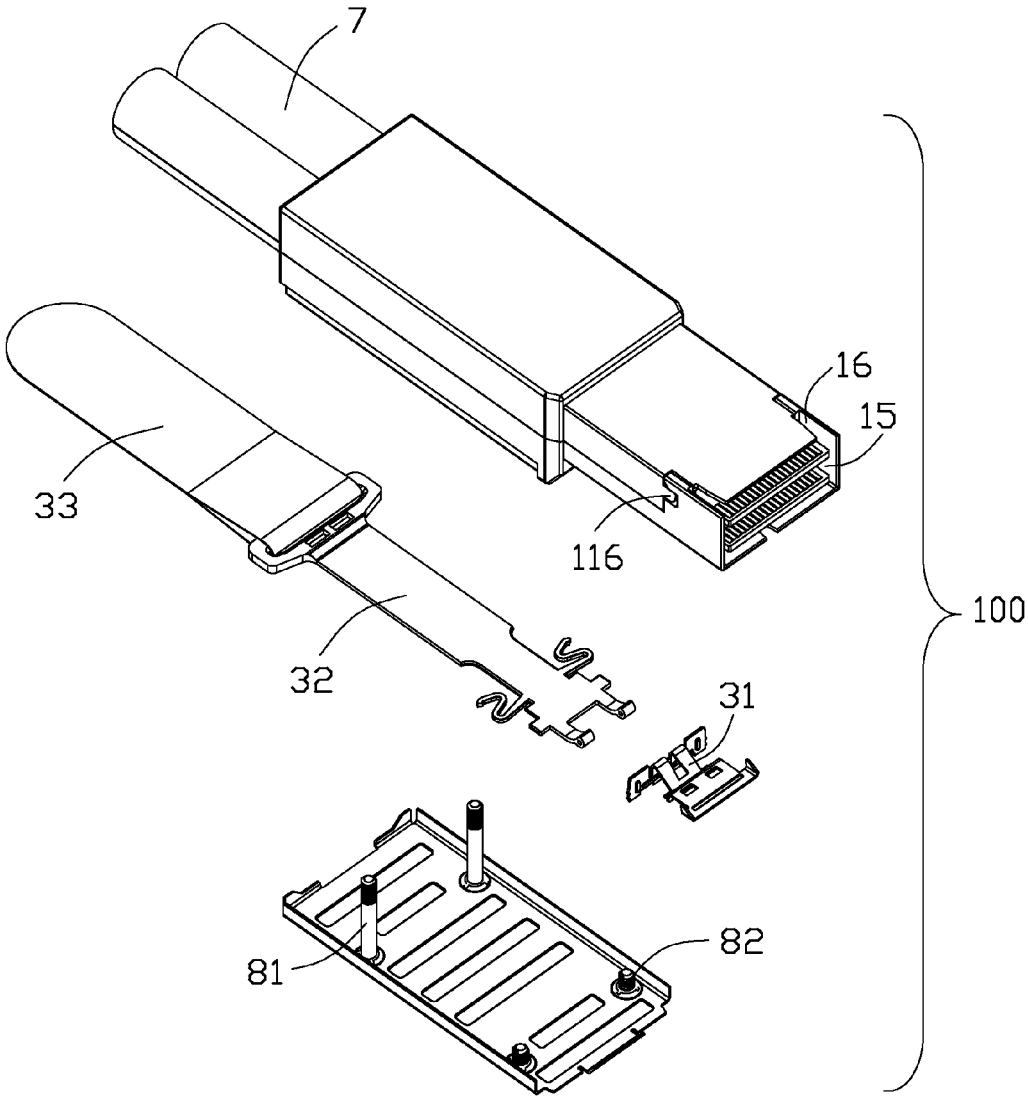
FIG. 4 is a bottom part exploded perspective view of the cable connector assembly of FIG. 1 wherein the latch mechanism and the metal shell are not assembled to the cable connector assembly.
Figure 5:
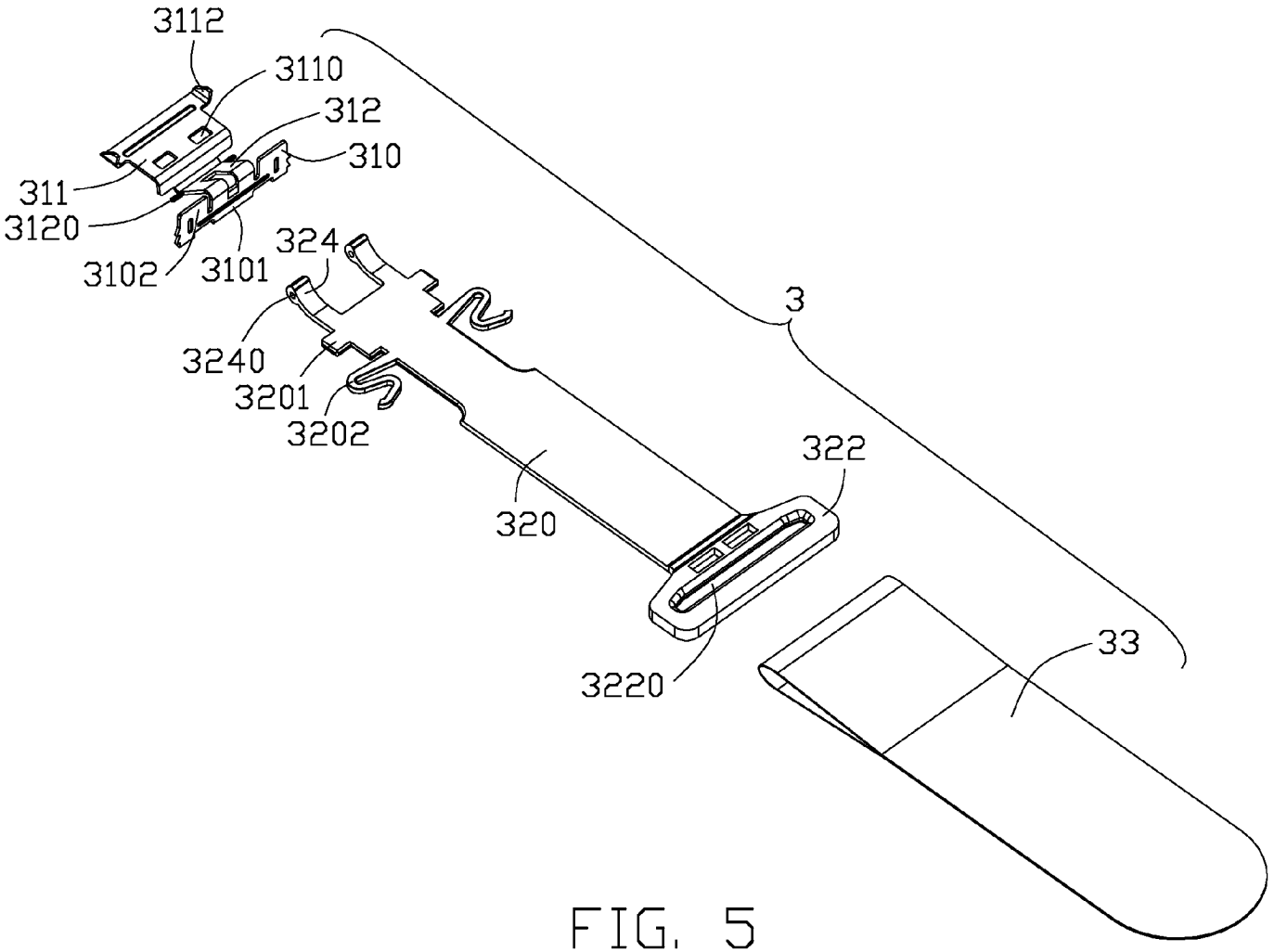
FIG. 5 is an exploded view of the latch mechanism of FIG. 1.
Figure 6:
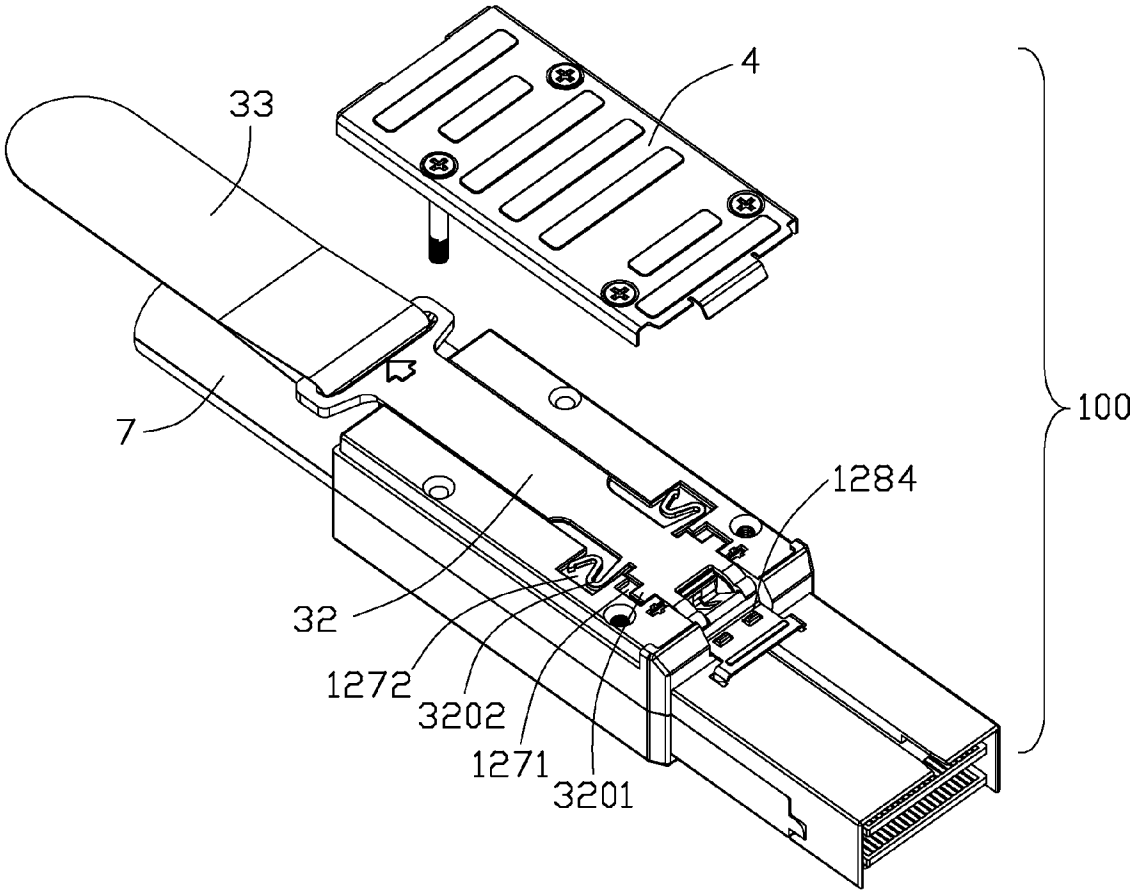
FIG. 6 is a top part exploded perspective view of the cable connector assembly of FIG. 1 wherein the metal shell are not assembled to the cable connector assembly.
Figure 7:
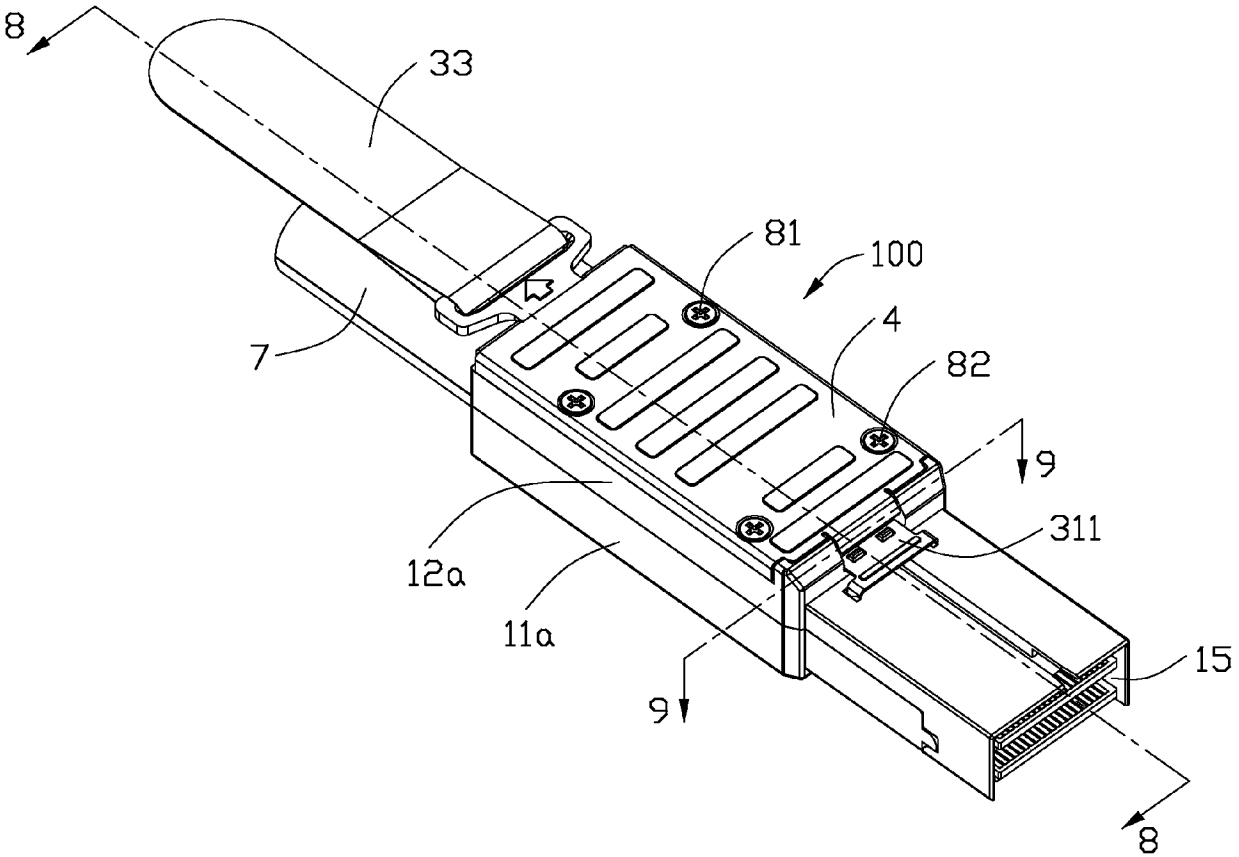
FIG. 7 is a perspective view of the cable connector assembly of FIG. 1.
Figure 8:
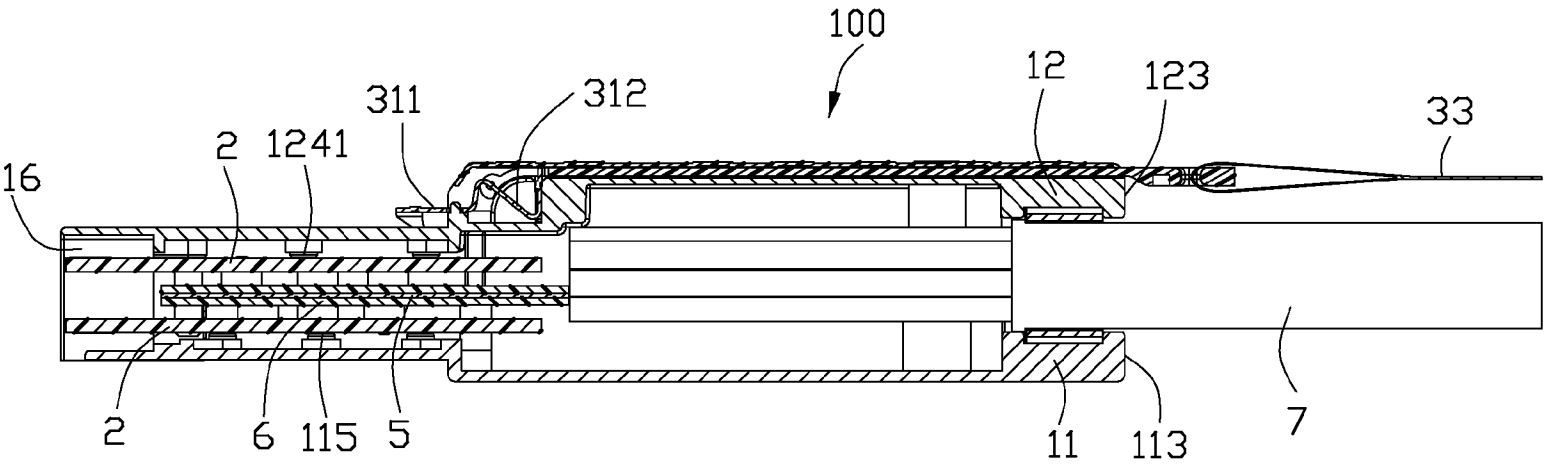
FIG. 8 is a cross sectional view of the cable connector assembly of FIG. 7 taken along line 8-8.

Referring to FIGS. 1, 3 and 4, the metal housing 1 includes a lower shielding part 11 and an upper shielding part 12 coupled with the lower shielding part 11. The lower shielding part 11 includes a first main portion 11*a* and a first mating portion 11*b* extending forwardly from the first main portion 11*a*. The first main portion 11*a* and the first mating portion 11*b* are configured with a step shape. The upper shielding part 12 includes a second main portion 12*a* corresponding to the first main portion 11*a* and a second mating portion 12*b* extending forwardly from the second main portion 12*a*. The first mating portion 11*b* and the second mating portion 12*b* are assembled to form a receiving room 16 communicating with an exterior by a mating port 15. The lower shielding part 11 defines a first bottom wall 110, a pair of first side walls 117 extending upwardly from two sides of the first bottom wall 110 and a first rear wall 113 extending upwardly from a rear side of the first bottom wall 110 and bridging two first side walls 117. The upper shielding part 12 defines a second top wall 120, a pair of second side walls 125 extending downwardly from two sides of the second top wall 120 and a second rear wall 123 extending downwardly from a rear side of the second top wall 120 and bridging the two second side walls 125. A front end of each first side wall 117 defines a protrusion 116. Each second side wall 125 is configured with L-shaped and defines a position groove 1252 located at a rear end of a wider section thereof to receive the protrusion 116. The first rear wall 113 forms a pair of first semi-columnar grooves 1130 and the second rear wall 123 forms a pair of second semi-columnar grooves 1230 corresponding to the first semi-columnar grooves 1130. Referring to FIG. 8, the first semi-columnar grooves 1130 and the second semi-columnar grooves 1230 are configured with a pair of columnar receiving cavities to receive the cables 7.

Figure 2:
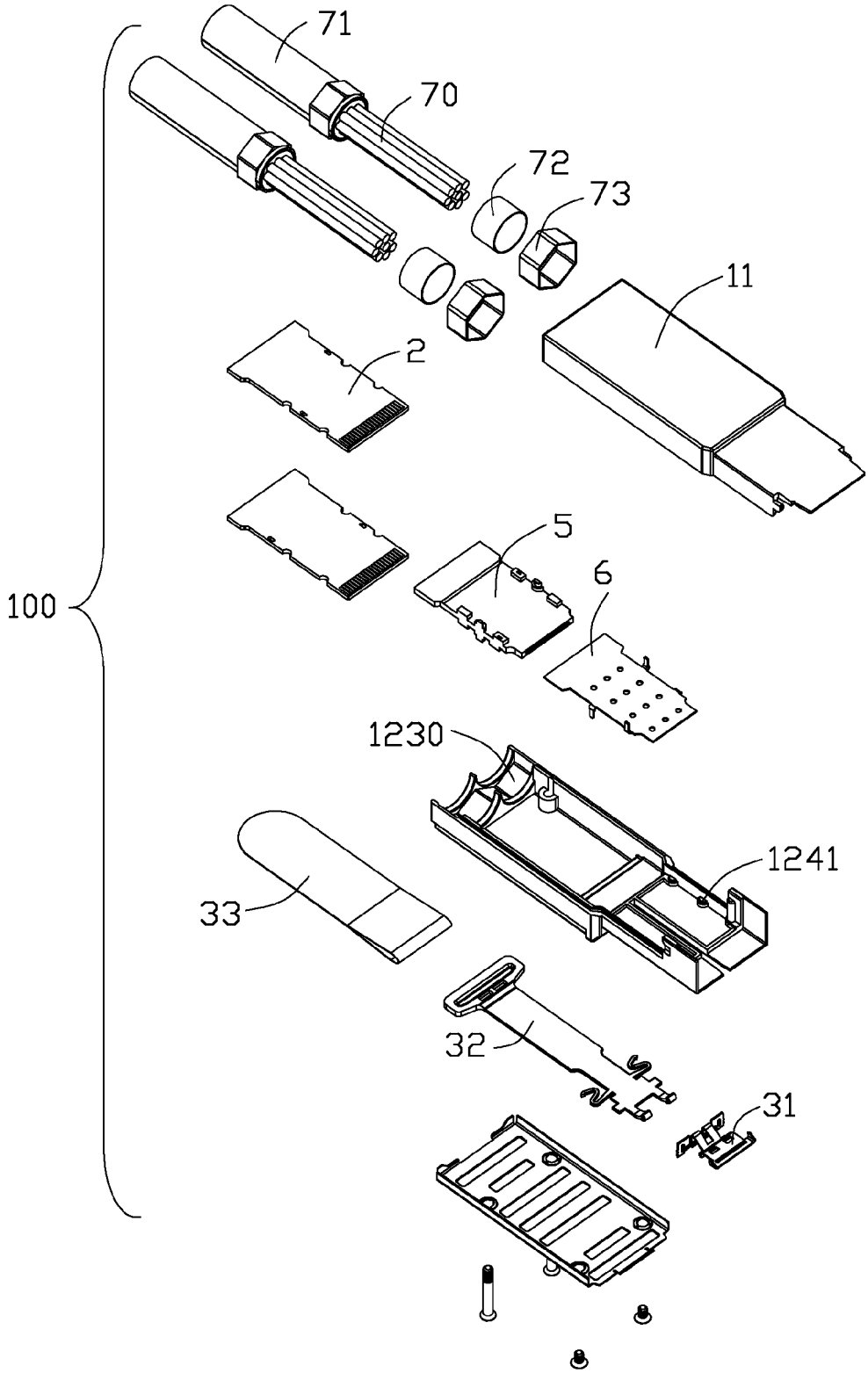
FIG. 2 is a bottom exploded view of the cable connector assembly of FIG. 1.

Referring to FIGS. 1, 2 and 8, the first bottom wall 110 of the first mating portion 11*b* defines a plurality of first ribs 115 arranged in two rows adjacent to the corresponding first side walls 117. The second top wall 120 of the second mating portion 12*b* defines a plurality of second ribs 1241 corresponding to the first ribs 115. The circuit boards 2 are put between the first ribs 115 and the second ribs 1241. The cable connector assembly 100 includes a partition wall 5 insert-molded with a metal board 6 therein, which is located between the two circuit boards 2. The partition wall 5 defines a plurality of tubers 51 at two side edges. The metal board 6 defines a plurality of through holes 61, a pair of first position legs 62 extending downwardly out of the tuber 51 of the partition wall 5 and a pair of second position legs 63 extending upwardly out of the partition wall 5. The two circuit boards 2 respectively define a pair of position holes 23. The position legs 62, 63 are inserted into the corresponding position holes 23 to secure the partition wall 5 and the circuit boards 2.

Referring to FIG. 3, an outside face 1202 of the second top wall 120 further defines a cutout 128 located at a front side of the second main portion 12*a* and a depressed area 127 running across the outside face 1202 in a front-to-rear direction. The cutout 128 protrudes a pair of arc-shaped blocks 1283 at two sides thereof and a pair of position blocks 1284 at a front side thereof. The position blocks 1284 are in front of the arc-shaped blocks 1283. The cutout 128 further defines a pair of narrow grooves 1280 extending outward from two sides of the cutout 128 and adjacent to the depressed area 127. The depressed area 127 includes a pair of first sunken portions 1271 and a pair of second sunken portions 1272 expanding outward from two sides thereof and arranged in two rows in the front-to-rear direction. The second mating portion 12*b* further defines a pair of latch grooves 1240 communication with the receiving room 16 and adjacent to the second main portion 12*a*.

Figure 9:
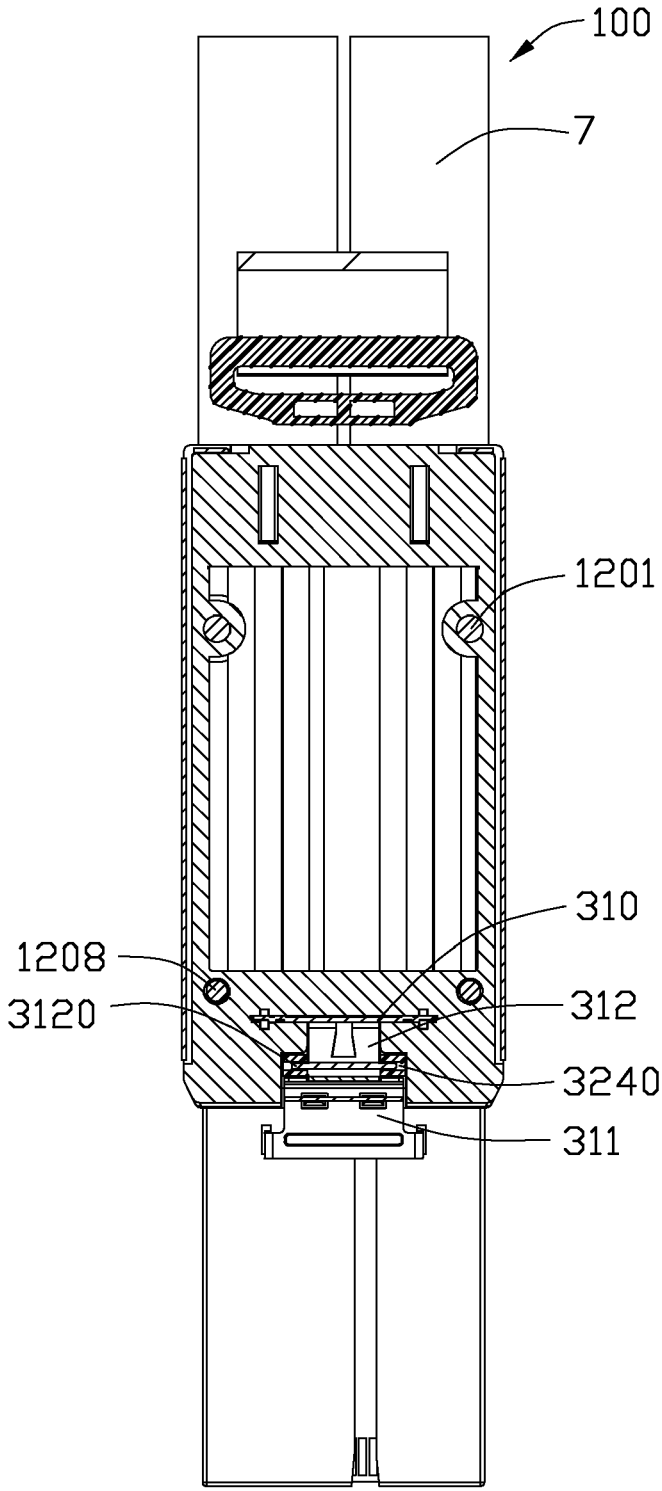
FIG. 9 is a cross sectional view of the cable connector assembly of FIG. 7 taken along line 9-9.

Referring to FIGS. 3-6, the latch mechanism 3 includes a latch member 31, a pulling member 32 and a pulling tape 33. The latch member 31 is made of metal material and includes a vertical engaging portion 310 through which the latch member 31 is retained in the metal housing 1, a flat latch portion 311 resisting against the outside face 1202 of the mating portion 12*b* and an inclined connecting portion 312 connecting the engaging portion 310 with the latch portion 311 to provide spring force to the latch mechanism 3. The engaging portion 310 includes a center base portion 3101 and a pair of flange portions 3102 extending from two sides of the base portion 3101. The base portion 31 located behind two arc-shaped blocks 1283 and the flange portions 3102 are received in the narrow grooves 1280. The latch portion 311 includes a pair of hook portions 3112 extending downwardly from two sides of a front end thereof and inserted into the latch grooves 1240 to grasp the metal housing 1. The latch portion 311 further defines a pair of fixing grooves 3110 to cooperate with the position blocks 1284. The connecting portion 312 forms a pair of shaft pins 3120 extending from two sides of a lowest location thereof. The pulling member 32 is made of insulative material and includes a pair of front cooperating portions 324, an elongated intermediate portion 320 extending rearward from the cooperating portions 324 and an operating portion 322 formed at a rear end of the intermediate portion 320. Each cooperating portion 324 is configured with an arc shape and defines a shaft hole 3240 at a front end thereof. The cooperating portion 324 abuts against the arc-shaped blocks 1283 and the shaft pin 3120 is inserted into the shaft hole 3240 referring to FIGS. 8 and 9. The intermediate portion 320 defines a pair of first arms 3201 movable located at the first sunken portions 1271 and a pair of second arms 3202 of S-shaped located at the second sunken portions 1272. The operating portion 322 defines a slot 3220 at a rear end thereof. The pull tape 33 is a piece of belt running across the slot 3220 and defines two opposite ends sticked to each other to fix the pull tape 33 to the pulling member 32. When the cable connector assembly is at a working station, the hook portions 3112 are inserted into the latch grooves 1240 and the first arms 3201 are located at a front side of the first sunken portions 1271. When a complementary connector is inserted into the mating port 15, the hook portions 3112 latch with the complementary connector. The shaft pins 3120 are pivotedly received in the shaft holes 3240. When a force acts on the pulling tape 33, the first arms 3201 is moved backward and actuate the latch member 31 moving by the rotation of the shaft pins 3120 and the shaft holes 3240 so that the hook portions 3112 move out of the receiving room 16 and the complementary connector is released from the receiving room 16.

Referring to FIGS. 1 and 2, each cable 7 includes a plurality of conductors 70, an insulative layer 71 enveloping a rear end of the conductors 70, an inner holding ring 72 enveloping a end of the insulative layer 71 and an outer holding ring 73 enveloping the inner holding ring 72. Each circuit board 2 defines two rows of conductive contacts 21 in the front-to-rear direction. The conductors 70 are soldered to a rear row of conductive contacts (not shown).

The metal shell 4 covers on the outside face 1202 of the second top wall 120 and defines a pair of first screws 45 and a first of second screws 46. The second top wall 120 defines a pair of third screws 1208 corresponding to the first screws 45 and a pair of fourth screws 1201 corresponding to the second screws 46. A pair of first bolts 82 is inserted in the first screws 45 and the third screws 1208 to secure the metal shell 4 and the metal housing 1. The first bottom wall 110 defines a pair of locking holes 1170. A pair of second bolts 81 is inserted in the second screws 46 and the fourth screws 1201 and the locking holes 1170 to fix the metal shell 4 and the lower shielding part 11 and the upper shielding part 12 together.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable connector assembly comprising:

a housing defining a receiving room therein and a mating port through which a complementary connector is inserted into the receiving room;

a plurality of conductive contacts located in the housing;

a plurality of cables electrically connecting with the conductive contacts;

a latch mechanism assembled to an outside face of the housing and comprising a latch member and a pulling member connecting with the latch member, the latch member defining a pair of hook portions inserted into the receiving room from the outside face and latching with the complementary connector;

wherein the latch member further defines a pair of shaft pins and the pulling member defines a pair of shaft holes, the shaft pins are pivotedly received in the shaft holes.

2. The cable connector assembly as claimed in claim 1, wherein the latch member comprises a flat latch portion, a vertical engaging portion and an inclined connecting portion, the shaft pins extending from a lowest location of the latch portion.

3. The cable connector assembly as claimed in claim 2, wherein the hook portions are located at two sides of a front end of the flat latch portion.

4. The cable connector assembly as claimed in claim 1, wherein the outside face of the housing defines a front cutout and a depressed area, the cutout protrudes a pair of arc-shaped blocks.

5. The cable connector assembly as claimed in claim 4, wherein the cutout comprises a pair of narrow grooves extending outsides, the engaging portion comprises a base portion behind the arc-shaped blocks and a pair of flange portions received in the narrow grooves.

6. The cable connector assembly as claimed in claim 5, wherein the pulling member comprises a pair of first arms and a pair of second arms, the first arms are movably located at a pair of first sunken portions and the second arms of S-shaped are located at a pair of second sunken portions.

7. The cable connector assembly as claimed in claim 6, wherein the latch member further defines a pair of fixing grooves to cooperate with the position blocks protruding from the cutout.

8. The cable connector assembly as claimed in claim 1, wherein the housing comprises a main portion and a mating portion extending from the main portion, the mating portion and the main portion are configured with step-shaped.

9. The cable connector assembly as claimed in claim 8, wherein the mating portion defines a pair of latch grooves receiving the hook portions.

10. A cable connector assembly comprising:

a metal housing comprising a lower shielding part and an upper shielding part coupled with the lower shielding part to define a receiving room with a mating port;

a pair of circuit boards received in the receiving room and comprising two rows of conductive contacts in a front-to-rear direction;

a plurality of cable electrically connecting with the rear row of conductive contacts;

a latch mechanism assembled to an outside face of the upper shielding part and comprising a latch member, a pulling member and a pulling tape connecting with each other in the front-to-rear direction;

wherein the latch member comprises a pair of shaft pins extending from two sides of a lowest location thereof and the pulling member comprises a pair of shaft holes at a front end thereof, the shaft pins rotationally received in the shaft holes.

11. The electrical connector as claimed in claim 10, wherein the latch member defines a pair of hook portions inserted into the receiving room, when the pulling tape is pulled back, the hook portion is driven out of the receiving room by the rotation of the shaft pins in the shaft holes.

12. The electrical connector as claimed in claim 11, wherein the pulling member comprises a pair of first arms and a pair of second arms, the first arms movable located at a pair of first sunken portions at the outside face of the metal housing and the second arms of S-shaped located at a pair of second sunken portions at the outside face of the metal housing.

* * * * *